US005163623A

United States Patent [19]

Seino

[11] Patent Number: 5,163,623

[45] Date of Patent: Nov. 17, 1992

[54] FUEL INJECTOR

[75] Inventor: Michael J. Seino, Rochester, N.Y.

[73] Assignee: General Motors Corporation, Detroit, Mich.

[21] Appl. No.: 708,665

[22] Filed: May 31, 1991

[51] Int. Cl.[5] ..... B05B 1/30

[52] U.S. Cl. ..... 239/585.3; 251/129.2

[58] Field of Search ..... 239/584, 585.1, 585.2, 239/585.3, 585.4, 586, 533.14; 251/129.16, 129.2

[56] References Cited

U.S. PATENT DOCUMENTS

| | | | |
|---|---|---|---|
| 2,294,421 | 9/1942 | Ray | 251/129.16 |
| 4,390,130 | 6/1983 | Linssen et al. | 251/129.16 |
| 4,572,436 | 2/1986 | Stettner et al. | 251/129.16 |
| 4,655,396 | 4/1987 | Taxon et al. | 239/585.3 |
| 4,660,770 | 4/1987 | Gieseking | 239/585 |
| 4,705,210 | 11/1987 | Graser et al. | 239/585 |
| 4,721,254 | 1/1988 | Horn | 239/585 |
| 4,905,962 | 3/1990 | Iljin | 251/129.16 |
| 4,958,773 | 9/1990 | Stettner et al. | 239/584 |
| 4,958,774 | 9/1990 | Taylor | 239/584 |
| 4,982,902 | 1/1991 | Knapp et al. | 239/585.3 |
| 5,048,564 | 9/1991 | Gaiardo | 251/129.2 |

FOREIGN PATENT DOCUMENTS

| | | | |
|---|---|---|---|
| 0225728 | 10/1987 | Japan | 251/129.16 |
| 2144060 | 2/1985 | United Kingdom | 251/129.16 |

*Primary Examiner*—Andres Kashnikow
*Assistant Examiner*—Christopher G. Trainor
*Attorney, Agent, or Firm*—Karl F. Barr, Jr.

[57] ABSTRACT

A fuel injector for a multi-cylinder internal combustion engine in which a single fuel injector meters fuel to a plurality of injection nozzles which discharge fuel adjacent to the engine inlet ports having a distributor with an outlet passage and a valve seat surrounding the passage, a single valve engaging the valve seat to control fuel delivery through the passage and a valve actuator adapted to pivotally displace the valve from the seat to contact a valve stop to allow fuel delivery through the passages. The stop surface comprises the lower surface of the valve body which houses the actuator and the center pole of the actuator. The center pole of the actuator extends beyond the lower surface of the body to provide a non-plannar valve stop surface which makes point contact therewith and avoids surface-to-surface contact between the members which may result in incidental adhesion therebetween.

3 Claims, 2 Drawing Sheets

FUEL INJECTOR

BACKGROUND OF THE INVENTION

1. Field of the Invention

The invention relates to a fuel injector for a multi-cylinder internal combustion engine in which a single fuel injector meters fuel to a plurality of injection nozzles which discharge fuel adjacent to the engine inlet ports.

2. Summary of the Invention

Fuel injectors of the type disclosed are illustrated in U.S. Pat. Nos. 4,958,773 and 4,958,774 issued Sep. 25, 1990. The injectors have a single, tapered valve controlling fuel flow to a plurality of fuel flow passages surrounded by a valve seat. A solenoid actuator is energized to cause the valve to pivot upwardly thereby displacing it from the valve seat and allowing fuel to flow through the outlet passages. The valve is constrained in its upward motion by contact with a stop surface which comprises the valve body and the center pole of the solenoid. The center pole of the solenoid is extended, beyond the lower surface of the valve body to provide an uneven stop surface against which the valve body rests in point contact. Point contact is desirable in that it avoids surface-to-surface contact between the members which may result in incidental adhesion therebetween which may affect the closing response of the injector.

Other objects and features of the invention will become apparent by reference to the following description and to the drawings.

DESCRIPTION OF THE PREFERRED EMBODIMENT

Figure 1:
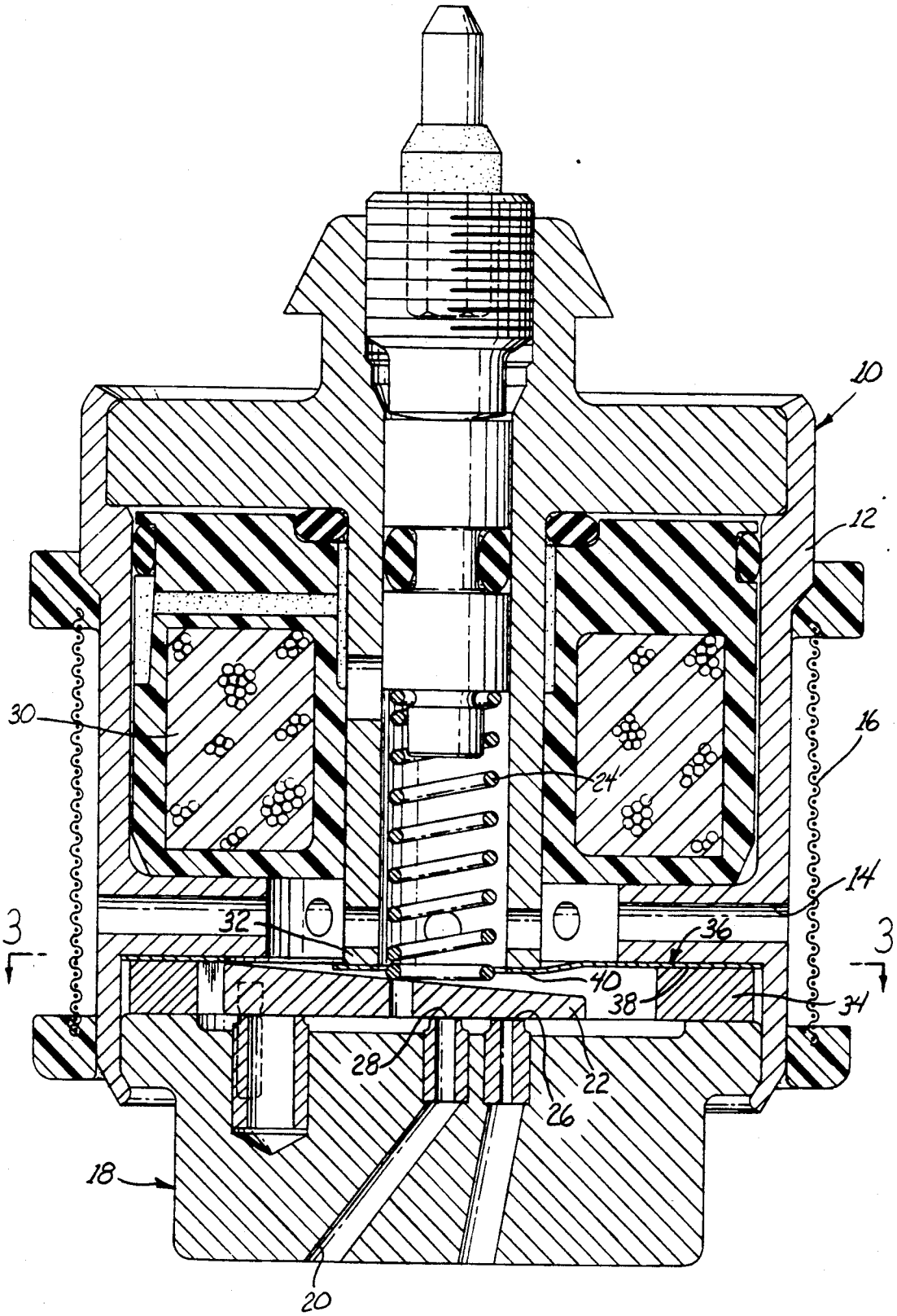
FIG. 1 is a sectional view of a fuel injector embodying the features of the present invention.

Referring to the drawings, an injector designated generally as 10 has a body 12 that receives fuel through a plurality of radial inlet passages 14 surrounded by a filter 16. A distributor 18 assembled to the lower portion of body 12 delivers fuel to a plurality of outlet passages 20, each of which directs fuel to an associated fuel nozzle (not shown).

A valve 22 controls the delivery of fuel through passages 20. Valve 22 is biased by a spring 24 to engage planar seating surfaces 26 formed by raised valve seats or lands 28, each surrounding one of the passages 20, and thereby interrupt fuel delivery through passages 20.

Figure 2:
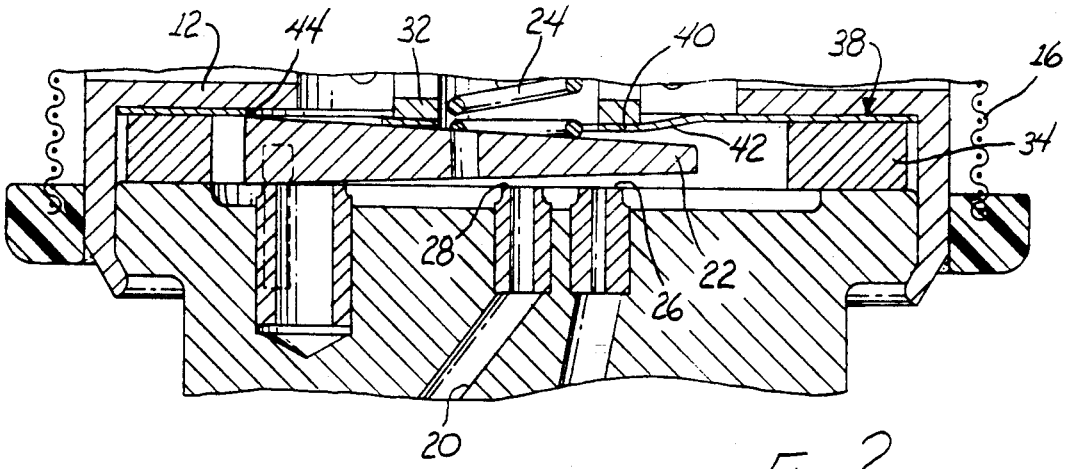
FIG. 2 is an enlarged sectional view of the lower portion of the fuel injector of FIG. 1, showing the valve lifted from its seat.

Injector 10 includes a solenoid having a coil 30, a center pole 32 surrounding spring 24, a spacer ring 34 surrounding valve 22, and a non-magnetic shim 36, disposed between body 12 and distributor 18 and center pole 32 and valve 22. As shown in FIGS. 1 and 2, center pole 32 extends slightly below the lower surface of injector body 12 causing shim 36 to be slightly non-planar, with the central portion pushed downwardly.

Figure 3:
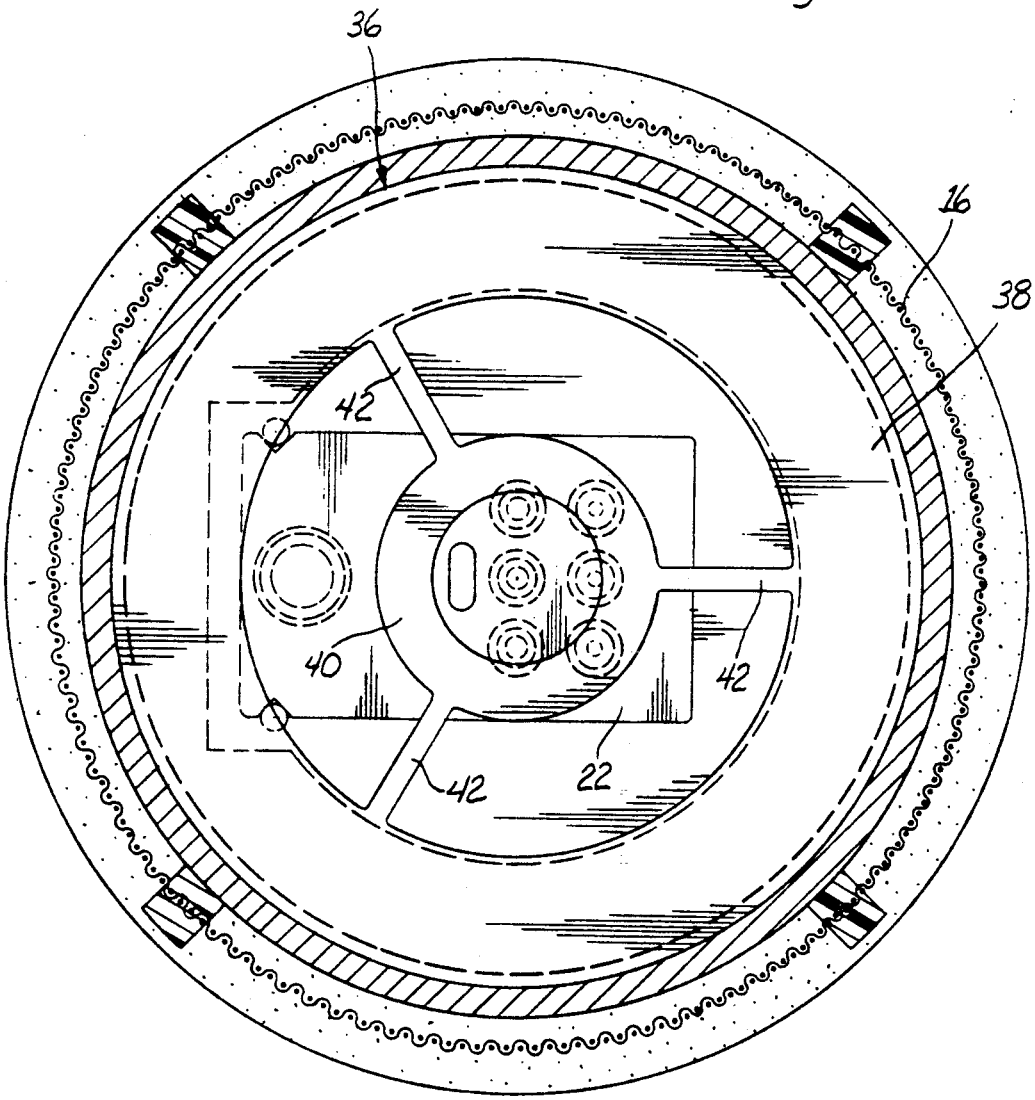
FIG. 3 is an enlarged sectional view of the injector of FIG. 1, taken along line 4—4.

In order to accommodate the extended pole 32, the shim 36 is configured as shown in FIG. 3 with a large outer annulus 38, sandwiched between body 12 and spacer ring 34, a small inner annulus 40, extending between center pole 32 and valve 22, and connecting arms 42 extending radially between large outer annulus 38 and small inner annulus 40. As illustrated in FIGS. 1 and 2, the arms 42 deflect to accommodate the extended pole 32.

Valve 22 is tapered from its thickest portion on the left, as viewed in FIGS. 1 and 2, to its thinnest portion on the right as viewed in the Figures. When the coil 30 is energized, to actuate valve 22 which acts as an armature, the thickest portion of the valve is lifted to engage the lower surface of shim 36 as at location 44 of FIG. 2. Engagement with the shim causes the valve 22 to pivot at 44, thereby lifting the valve from lands 28 to allow fuel delivery through passages 20. Due to the non-planar shim surface caused by the extended center pole 32, the upper surface of the valve 22 rests in point contact with the shim 36 rather than in surface-to-surface contact as would occur if the lower end of the center pole did not extend beyond the lower surface of body 12. Point contact eliminates incidental adhesion between the surfaces as tends to occur between two flat surfaces placed in face to face contact in a fluid medium; commonly referred to as joblocking. Such adhesion may cause variation in the closing of valve 22 which is undesirable for overall injector performance.

While one embodiment of the invention has been described in detail above in relation to a fuel injector, it would be apparent to those skilled in the art that the disclosed embodiment may be modified. Therefore, the foregoing description is to be considered exemplary, rather than limiting, and the true scope of the invention is that described in the following claims.

The embodiments of the invention in which an exclusive property of privilege is claimed are defined as follows:

1. An injector comprising a body a distributor having an outlet passage and a valve seat surrounding said passage, a valve engaging said valve seat to interrupt fuel delivery through said passage, a solenoid actuator having a center pole, said actuator adapted to pivotally displace said valve from said valve seat to contact a stop surface thereby allowing fuel delivery through said passage, said stop surface having a non-planar configuration so as to make point contact with said valve to avoid surface-to-surface contact therebetween.

2. An injector, as defined in claim 1, wherein said stop surface comprises the lower face of said injector body and said center pole of said solenoid actuator, said center pole extending beyond the lower face of said body to form said non-planar configuration.

3. An injector, as defined in claim 2, wherein said valve and said stop surface are separated by a non-magnetic shim having an outer annular portion disposed between said injector body and said distributor, an inner annular portion disposed between said extended center pole and said valve, and a plurality of radial connecting arms extending therebetween and deflectable to accommodate said extended center pole.

* * * * *